US007305727B2

(12) United States Patent
Horlin

(10) Patent No.: US 7,305,727 B2
(45) Date of Patent: Dec. 11, 2007

(54) SICK-BED

(76) Inventor: Albrecht Horlin, An der Bilz 11, 63906 Erlenbach (DE)

( * ) Notice: Subject to any disclaimer, the term of this patent is extended or adjusted under 35 U.S.C. 154(b) by 116 days.

(21) Appl. No.: 11/069,950

(22) Filed: Mar. 3, 2005

(65) Prior Publication Data

US 2005/0273932 A1 Dec. 15, 2005

Related U.S. Application Data

(63) Continuation-in-part of application No. 10/169,674, filed as application No. PCT/EP00/13262 on Dec. 22, 2000, now abandoned.

(30) Foreign Application Priority Data

Jan. 11, 2000 (DE) ..... 100 01 687

(51) Int. Cl.
*A61G 7/005* (2006.01)
*A61G 7/008* (2006.01)

(52) U.S. Cl. ..... 5/607; 5/608; 5/609

(58) Field of Classification Search ..... 5/607–609; 108/4, 7

See application file for complete search history.

(56) References Cited

U.S. PATENT DOCUMENTS 3,288,421 A 11/1966 Peterson
3,742,527 A 7/1973 Johnston et al.
3,900,906 A 8/1975 Berthelsen
4,847,929 A * 7/1989 Pupovic ..... 5/608
4,912,787 A 4/1990 Bradcovich
5,095,560 A 3/1992 Volker
5,410,768 A 5/1995 Manson et al.
5,621,933 A * 4/1997 Knapp et al. ..... 5/608
6,505,363 B2 1/2003 Davis
6,640,363 B1 * 11/2003 Pattee et al. ..... 5/601
2002/0084389 A1 7/2002 Larson
2002/0144350 A1 10/2002 Shih

FOREIGN PATENT DOCUMENTS

EP 0 799 010 B1 12/1999

* cited by examiner

*Primary Examiner*—Michael Trettel
(74) *Attorney, Agent, or Firm*—Buchanan Ingersoll & Rooney PC

(57) ABSTRACT

A sick-bed includes a bedstead and a bed frame with an adjustable mattress support. The bed frame can be mounted cardanically on the bedstead for the decubitus prophylaxis and can be precessed by means of a drive unit. The bed frame is cardanically suspended on at least three, preferably four lifting drives, which are separate from each other and continuously height-adjustable. The lifting drives are controllable in such a manner that the central normal of the bed frame running through the center of gravity for the bed frame is allowed to carry out a continuous, damped and slow precession movement. Universal joints connecting the lifting drives to the bed frame can allow limited sliding movement therebetween in longitudinal and/or transverse directions.

3 Claims, 9 Drawing Sheets

SICK-BED

CROSS-REFERENCE TO RELATED APPLICATION

This application is a continuation-in-part of U.S. Ser. No. 10/169,674, filed Jul. 8, 2002, now abandoned, by Albrecht Hörlin for a Sick-Bed.

SPECIFICATION

The invention relates to a sick-bed, wherein, for the decubitus prophylaxis, a dimensionally stable bed frame as the mattress support, is cardan-mounted on a bedstead, and can be precessed by means of a drive unit.

A sick-bed of this kind is known from European Patent Specification EP 799 010 B1. This sick-bed mounts the bed frame centrally on the bedstead in the gravity center of the bed frame by means of an axial ball bearing, the bearing shells of which receive the roller bodies, being precessable relative to each other. This is caused by a wedge disk arranged between the bearing shells and mechanically actuated through a pinion gear.

While the decubitus prophylaxis with the known bed leads to extremely satisfying results, the bearing application and the conception of the precession drive of the bed frame on the bedstead have turned out to be problematic. Problems arose, for one, in the nursing sector, where many manipulations and aid to be stored temporarily require a sufficiently free space below the gravity center zone of the bedstead, and for another, are due to the scope of mechanical experiences with said known drive. Thus, said known drive is relatively expensive and heavy, necessitates a comparably complex installation, and requires, and this in turn also with respect to the nursing situation, an arrangement of the mechanical drive directly on the sick-bed. This is often regarded as being disturbing, and namely even then when the drive is not fixed on the bed frame but on the bedstead.

SUMMARY OF THE INVENTION

Starting from this prior art, the invention is based on the technical problem of further developing the known medical sick-bed for the decubitus prophylaxis in such a manner that the bed center remains unobstructed, that the precession drive is allowed to be configured noiseless, and namely also noiseless over the long term, and is allowed to be configured of a mechanically higher resistance than the strongly loaded bearing shells and the bearing drive known from prior art.

The invention solves this problem by means of a sick-bed, the bed frame of which is not mounted on roller bearings but on at least three lifting drives height-adjustable in a continuous and arbitrarily reversible manner, the operation thereof being arranged coordinate in such a way that the initially mentioned precession data are allowed to be set without problems and, above all, without noise. With this configuration of the bearing and the precession drive, a change of the precession frequency, as well as of the precession amplitude can in particular be achieved in a considerably simpler manner than it is possible with the mechanical roller bearing according to the prior art. According to the invention, it is moreover possible to mount the bed frame height-adjustable and inclination-adjustable with respect to its stationary position.

Preferably, four continuously height-adjustable lifting drives vertically fixed to the bedstead are used, each carrying the bed frame in the zone of its four corners. This articulation to the bed frame is thereby configured cardanically, for example by means of a ball-and-socket joint or a cardanic joint.

For achieving a highest possible mobility of the sick bed intended for the decubitus prophylaxis, the continuously height-adjustable lifting drives according to an embodiment of the invention are configured as an adjustable electromotive telescopic lifting column.

For creating the desired position of the bed frame, e.g., for the simple static height adjustment or the inclination angle adjustment or even for the dynamically oscillating or precessional motion, threaded spindles are provided for each telescopic lifting column.

The number and height of the telescoping spindles thereby corresponds to the amount of the maximally required height adjustment or, with respect to the mobility of the bed, to the amount of the maximally required amplitude.

The telescopic lifting column is realized in such a manner that within a cylindrical outer sleeve, a working rod is disposed, within which, for example, two threaded spindles with the corresponding spindle nuts are provided intended for a two-fold height adjustment of the lifting columns.

The height adjustment itself ensues by coupling said spindles to an electronically driven electric motor via a gear, for example a planetary gear, and via corresponding toothed wheels. In particular, each lifting spindle is thereby assigned an electric motor of its own.

For the height adjustment furthermore, either the electric motor is configured as a reversing motor or the gear is configured as a reversing gear. Thereby, the drive unit for the telescopic lifting column is in particular conceived in such a manner that it allows for a mobile energy supply. Moreover, said drive unit should feature dimensions as small as possible relative to the size of the telescopic lifting column itself.

With respect to the use in a sick-room, moreover, only electric motors as silent as possible should be used as drive units. Also, a particularly effective acoustic decoupling, at least a sound absorption has in addition to be provided for, preventing a transmission of structure-borne noise from the drive unit into the bedstead and the bed frame, as well as an emission of airborne noise from the drive unit into the sick-room.

The working rod of the telescopic lifting column, which rod is guided within the cylindrical sleeve, comprises on its end an articulation ball head forming a cardanic ball-and-socket joint with a corresponding ball socket of the bed frame, or is articulated to the bed frame via a cardanic universal joint. In these bearing locations, the means for the absorption of the structure-borne noise or for the decoupling of the structure-borne noise are in particular arranged.

If the telescopic lifting column is supposed to create movements with a high precession frequency and maximum amplitude, then the cardanic suspension has to be realized preferably via universal joints.

According to a second embodiment of the invention, the height-adjustable lifting drives are configured as a hydraulically integrated constructional unit with a hydraulic working cylinder, and namely preferably so that each of the working cylinders is equipped with a pump of its own and with a central control valve of its own having a closed hydraulic circuit. The hydraulic compressors used thereby are preferably acted upon electrically and are controlled electronically. With the use and installation of electric energy storage in the bedstead, such a prophylaxis bed is mobile even for a longer period of time and can be used independent of an external supply.

If, however, an absolute silence of the precession drive has to be set, and the capacity of a mobile displacement of the prophylaxis bed is of secondary importance, then the hydraulic working cylinders are configured without an integrated compressor and without an integrated valve, instead, all hydraulic working cylinders are connected to a central hydraulic multiple valve which can be controlled in a programmed manner, which multiple valve is connected to a common external pressure supply, for example, to a hydraulic compressor standing isolated in the next room, or to an already existing central hydraulic pressure supply line. The hydraulic working cylinders themselves, which cause the precession of the bed frame, work without any noise development, and thereby work continuously and vibrationless to the highest degree.

BRIEF DESCRIPTION OF THE DRAWINGS

Many objects and advantages of this invention will be apparent to those skilled in the art when this specification is read in conjunction with the attached drawings wherein like reference numerals are applied to like elements and wherein.

DETAILED DESCRIPTION OF THE PREFERRED EMBODIMENTS

Figure 1:
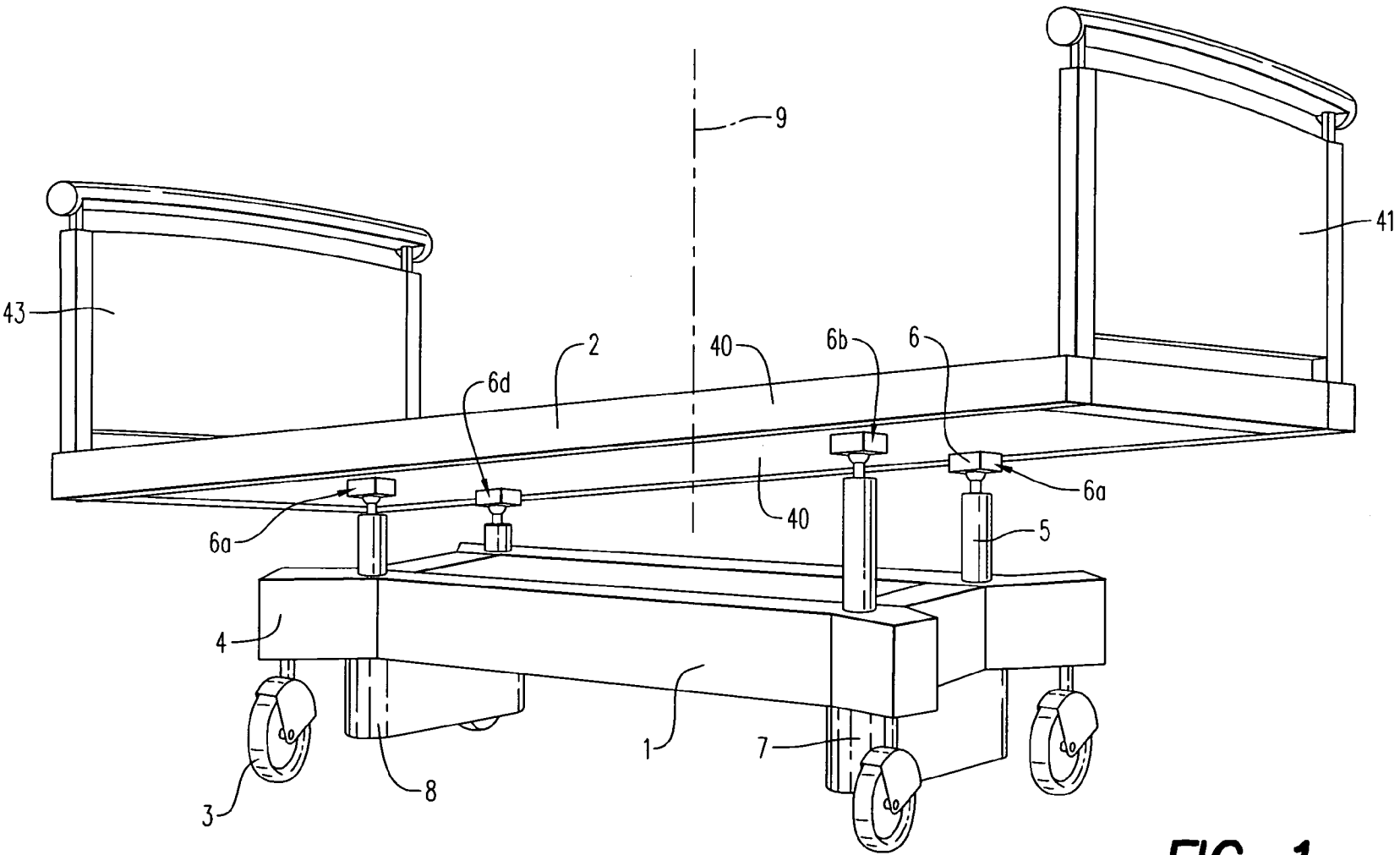
FIG. 1 is a schematic perspective representation of a sick-bed exhibiting features of the invention.

The sick-bed shown in FIG. 1 is comprised of a bedstead I and a rigid and dimensionally stable bed frame 2. For convenience, it will be useful to refer to longitudinal and transverse directions on the bed frame 2. The bed frame 2 will be considered to have a longitudinal direction extending between a first end 41 and a second end 43 of the bed frame 2 and being generally parallel to side rails 40 of the bed frame. In addition, a transverse direction extends between the side rails 40 of the bed frame 2 generally perpendicularly to the longitudinal direction.

The bedstead 1 is configured substantially rectangular, and is so dimensioned that it remains just slightly within the outer dimensions of bed frame 2. By means of four wheels 3 articulated to cantilevers 4 of bedstead 1, the sick-bed is designed to be movable. A line 9 normal to a plane of the bed frame 2 also passes through the center of gravity for the bed frame 2.

Figure 2:
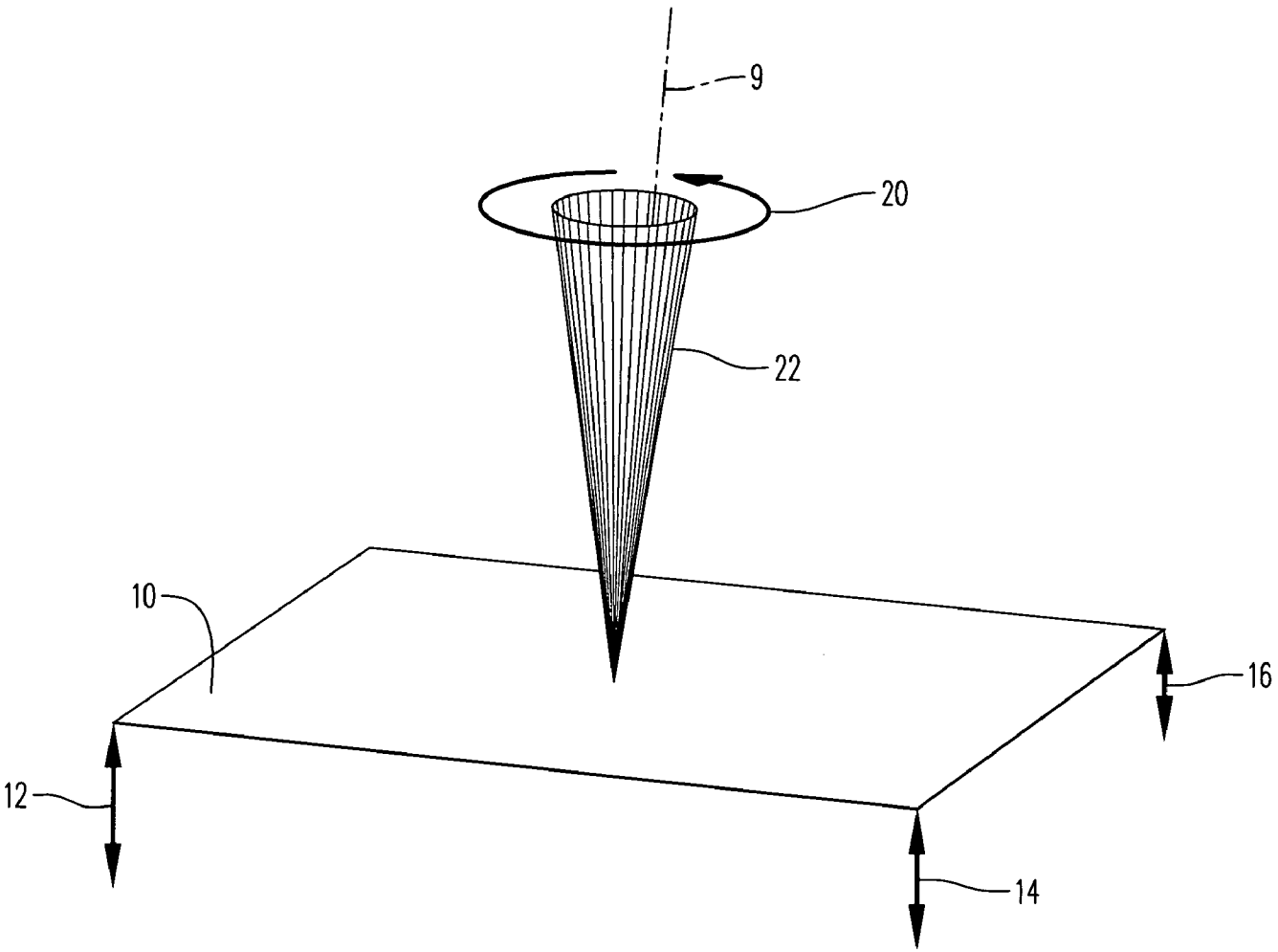
FIG. 2 is schematic illustration of the precession movement according to the present invention.

The bed frame 2 is constructed and arranged relative to the bedstead 1 so that a plane 10 (see FIG. 2) fixed to the bed frame 2 having the normal line 9 (i.e., perpendicular to the plane 10) moves in a manner that is best described as precession. That movement is effected by controlled movement of the corners of the plane 10 upwardly and downwardly as indicated by the arrows 12, 14, and 16. The fourth corner also can move vertically but the movement arrows under the plane 10 at that corner would be obscured by the plane 10. Movement of the plane 10 as well as the bed frame 2 relative to the bedstead 1 may be accomplished by a plurality of hydraulic working cylinders 5 (see FIG. 1) each of which is positioned in the region around a corner of the bed frame 2.

The concerted action of the working cylinders 5 is such that the normal line 9 (see FIG. 2) moves along an imaginary conical surface 22. Depending upon the particular location of the center of movement, the conical surface 22 could be a frustoconical surface. In any event, as the bed frame 2 moves, the normal line 9 moves in the direction of the arrow 20 and sweeps along the imaginary conical surface 22. Stated differently, the normal line 9 functions as the generatrix of the conical surface 22.

For achieving an optimum decubitus prophylaxis, a precession frequency for the plane 10 is preferably in the range of between 6 and 36°/min, with a maximum amplitude in the range of between 3 and 10 cm. The maximum amplitude is measured relative to the maximum vertical excursion from the horizontal of a patient of average size laid on the bed. Amplitude adjustments are contemplated to accommodate the actual size of any patient, but the preferred maximum amplitude range is as indicated. For convenience, the amplitude measurement may be taken at the corners of the bed frame 2. For purposes of this invention, precession frequency refers to the angular movement per unit time of the normal line 9 along the conical surface 22 in the direction of the arrow 22 around the axis of that conical surface 22. These ranges of precession frequency and precession amplitude have been found to be suitable to accomplish optimal decubitus prophylaxis.

Figure 3:
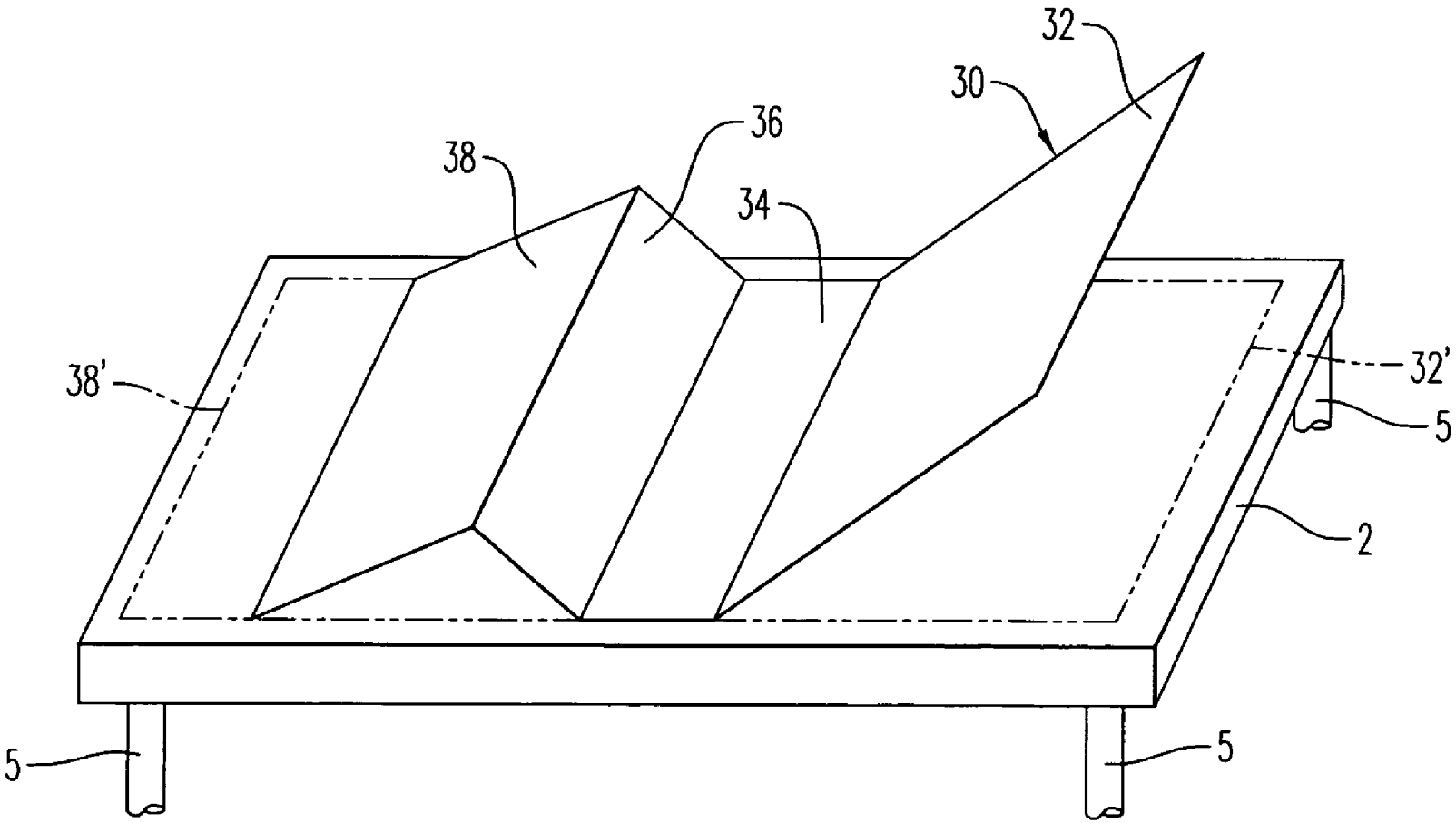
FIG. 3 is a schematic illustration of an adjustable support surface according to the present invention.

It is also within the contemplation of this invention that the bed frame 2 have an adjustable mechanism 30 (see FIG. 3) operable to raise and lower a portion of a mattress supporting the region of a patient's upper body, and operable to raise and lower another portion of a mattress typically supporting the region of a patient's upper and lower legs and feet. For example, an upper body panel 32 may be hingedly connected to the bed frame 2 so as to be movable between a first flat position 32' which is generally coplanar with the top of the bed frame 2 and a second elevated position where one end of the upper body panel 32 is elevated above the bed frame. In addition, an upper leg panel 36 can be hingedly connected to the bed frame 2 and to a lower leg panel 38. An edge of the lower leg panel 38 can be arranged to slide along the bed frame 2 when the hinged edged is elevated. At the same time, the upper leg panel 36 is elevated so that the panels 36, 38 support a patient's legs in a flexed position. If desired, side panels (not shown) extending vertically along the side edges of one or more of the panels 32, 34, 26, 28 may be provided to help prevent a patient from inadvertently moving beyond the peripheral edge of the bed frame 2. To articulate the upper body panel 32 and the upper and lower leg panels 36, 38, suitable conventional power mechanisms may be provided. Typically, such mechanisms may be hydraulically, pneumatically, or electrically driven. Furthermore, suitable conventional operational controls may be provided that are patient accessible.

Turning now to the system for operating the precession of the bed frame 2 relative to the bedstead 1, a continuously height-adjustable telescopic lifting columns 5 is fixed In the zone or region of each of the four outer corners of the bedstead 1. All of the four telescopic lifting columns are realized identical. Each of the height-adjustable columns 5 is vertically fixed to the bed frame in a rigid and stationary manner, hence, for example, welded or screwed with same. On the head of each working rod of each telescopic lifting column 5, an articulation ball head may be provided which forms a cardanic ball-and-socket joint, a corresponding ball socket being attached to the bed frame 2. The lifting columns are the sole support for the bed frame so that the region under the bed frame 2 is open and essentially unobstructed.

The cardanic joint 6 may also be configured as a universal joint. In any event, the cardanic joints 6 are constructed and arranged so as to be releasable from the head of the working rod of the telescopic lifting column 5. In this manner, the bed frame 2 can be moved after an adjusting manipulation even without the bedstead and its lifting drives. Thus, the bed frame 2 can be transferred, for example during emergency cases or situations, onto a secondary undercarriage.

Depending upon the dimensions of the bed frame 2 and the precession amplitude ranges being provided, it may be desirable to arrange the cardanic connection between the lifting columns 5 and the bed frame 2 so that lateral movement of the bed frame 2 can occur relative to at least some of the lifting columns 5. This connection arrangement may, for example, be desired when a full size patient bed is to be mounted and where the upper end of the precession amplitude range is to be accommodated.

In such situations, a universal joint arrangement may be provided for each of the lifting cylinders 5 (see FIG. 1). One of the universal joints 6*a* may be constructed and arranged so that the bed frame 2 is not permitted to move in either the longitudinal or transverse direction relative to the corresponding lifting cylinder. A second universal joint 6*b* at one corner of the bed frame adjacent to the first universal joint 6*a* may be constructed and arranged to accommodate longitudinal movement of the bed frame 2 relative to the corresponding lifting cylinder to accommodate longitudinal sliding associated with different elevations of the lifting cylinders corresponding to the universal joints 6*a* and 6*b*. A third universal joint 6*d* at another corner of the bed frame 2 adjacent to the first universal joint 6*a* may be constructed and arranged to accommodate transverse movement of the bed frame 2 relative to the corresponding lifting cylinder to accommodate transverse sliding associated with different elevations of the lifting cylinders corresponding to the universal joints 6*a* and 6*d*. A fourth universal joint 6*c* at an opposite corner of the bed frame 2 may be constructed and arranged to accommodate both longitudinal and transverse movement of the bed frame 2 relative to its corresponding lifting cylinder to accommodate both transverse and longitudinal sliding associated with different elevations between the lifting cylinders corresponding to the universal joints 6*a* and 6*c*.

Figure 4:
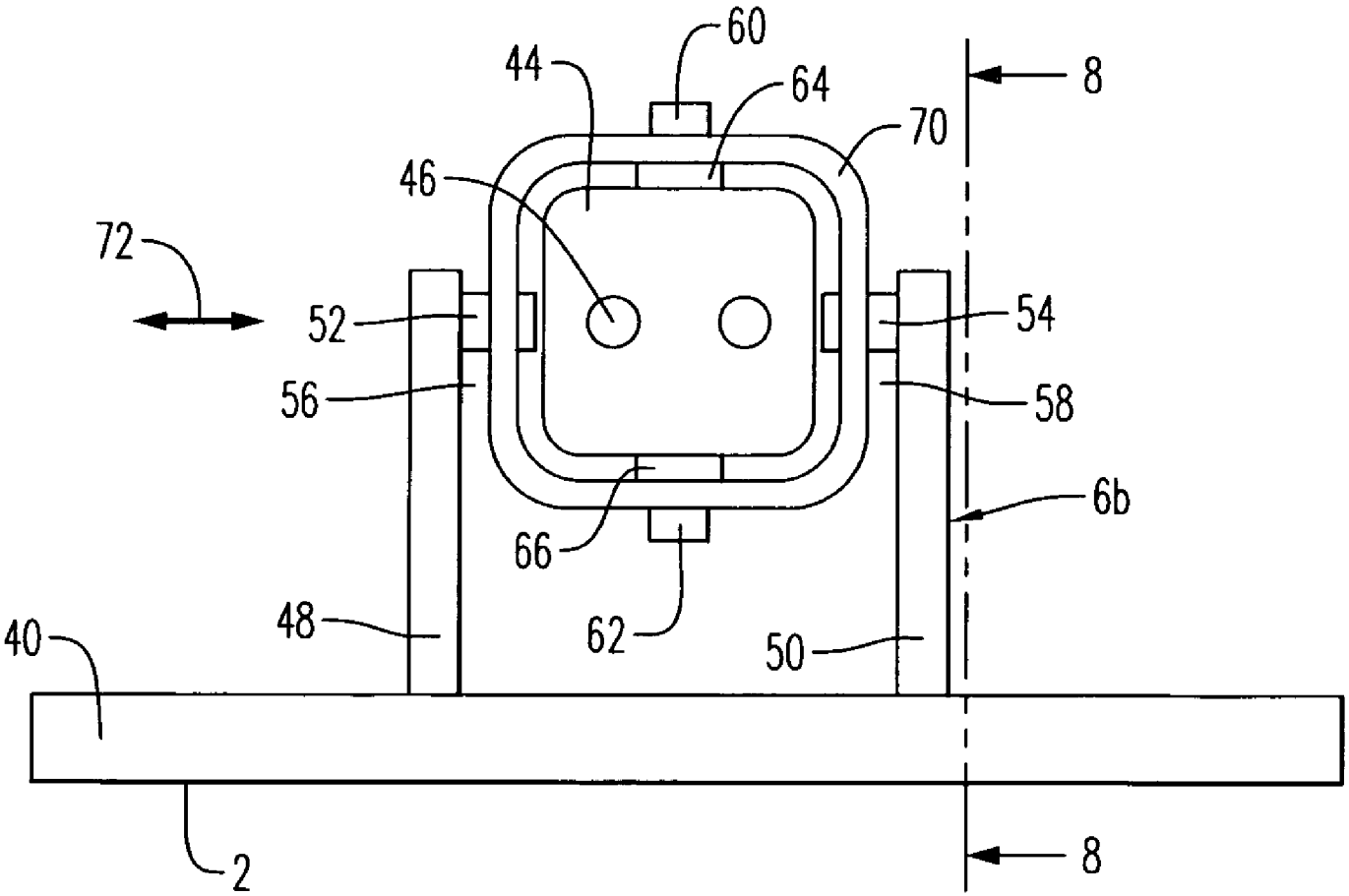
FIG. 4 is a plan view of a longitudinally adjustable universal joint according to the present invention.

Turning now to FIG. 4, details of a preferred embodiment of the longitudinally slidable universal joint 6*b* are shown. The universal joint 6*b* includes cap 44 adapted to be attached to the upper end of the corresponding lifting cylinder by one or more suitable conventional threaded fasteners 46. A pair of generally parallel arms 48, 50 extends from the side rail 40 in the transverse direction toward the central region of the bed frame 2. Each arm 48, 50 carries a corresponding generally cylindrical axle pin 52, 54. The axle pins 52, 54 are coaxially aligned and generally parallel to the side rail 40. The axle pins 52, 54 may be threadably connected to the corresponding arms so as to be removable. In addition, the axle pins 52, 54 connect with a generally rectangular collar 70 such that the collar can rotate about the aligned axle pins 52, 54 relative to the arms 48, 50 and can slide longitudinally along the axle pins 52, 54 between those arms. Thus, the collar 70 is spaced from the arms 48, 50, at the gaps 56, 58, but the relative size of the gaps 56, 58 is selected to accommodate any longitudinal movement that may be needed as the bed frame 2 precesses.

Figure 8:
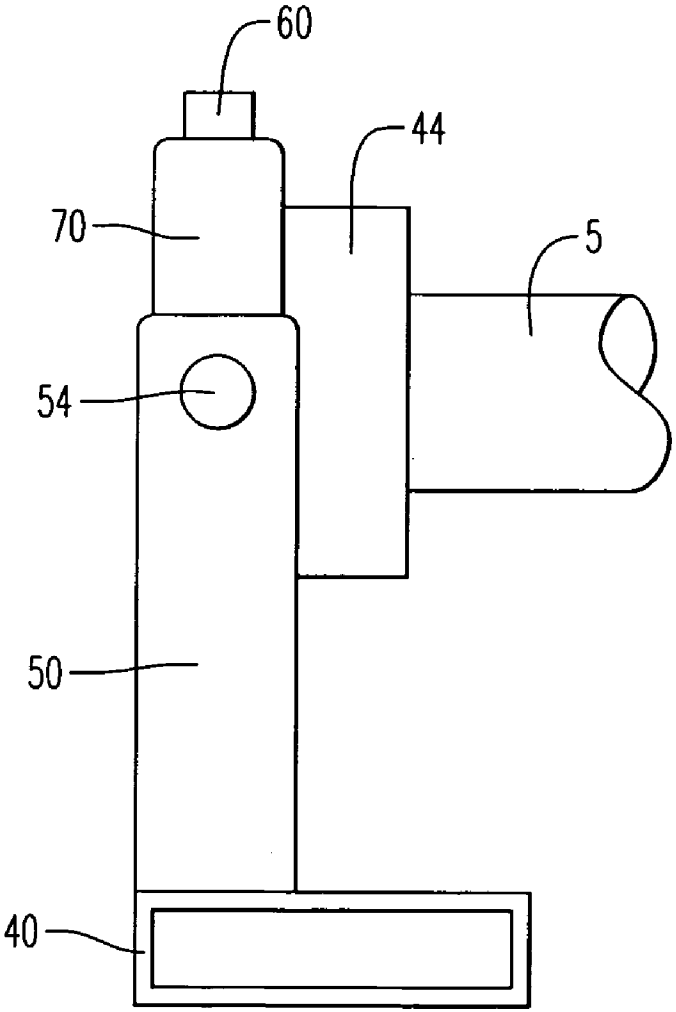
FIG. 8 is a partial cross-sectional view taken along the line 8-8 of FIG. 4.
Figure 9:
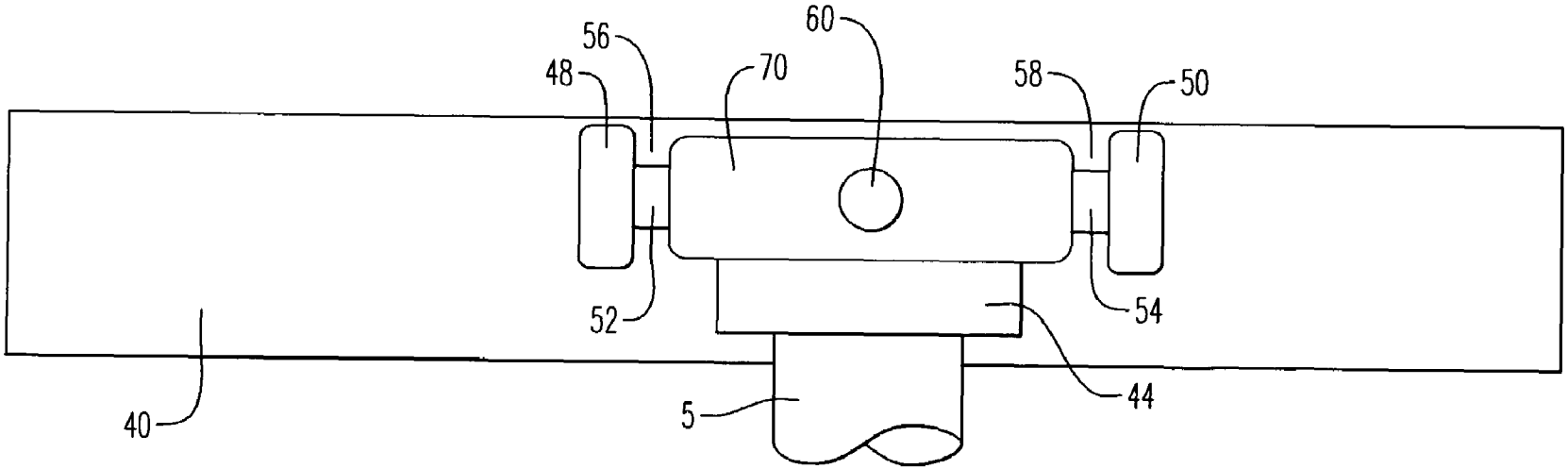
FIG. 9 is a top view of the universal joint of FIG. 4.

The cap 44 includes a pair of axle pins 60, 62 which are coaxially aligned and extend on opposite sides of the cap 44 to connect the cap 44 with the collar 70. The axle pins 60, 62 are coaxially aligned and extend in the transverse direction of the bed frame. Each axle pin 60, 62 includes a bushing or radial step 64, 66 having a larger lateral dimension than the end of the pin so that the collar 70 can rotate about the pins 60, 62 but is constrained from substantial sliding movement along the axle pins 60, 62. The universal joint 6*b* thus permits sliding movement in the direction of arrow 72 while otherwise permitting angular movement between the corresponding lifting cylinder 5 and the bed frame 2 (see FIGS. 8 and 9).

Figure 5:
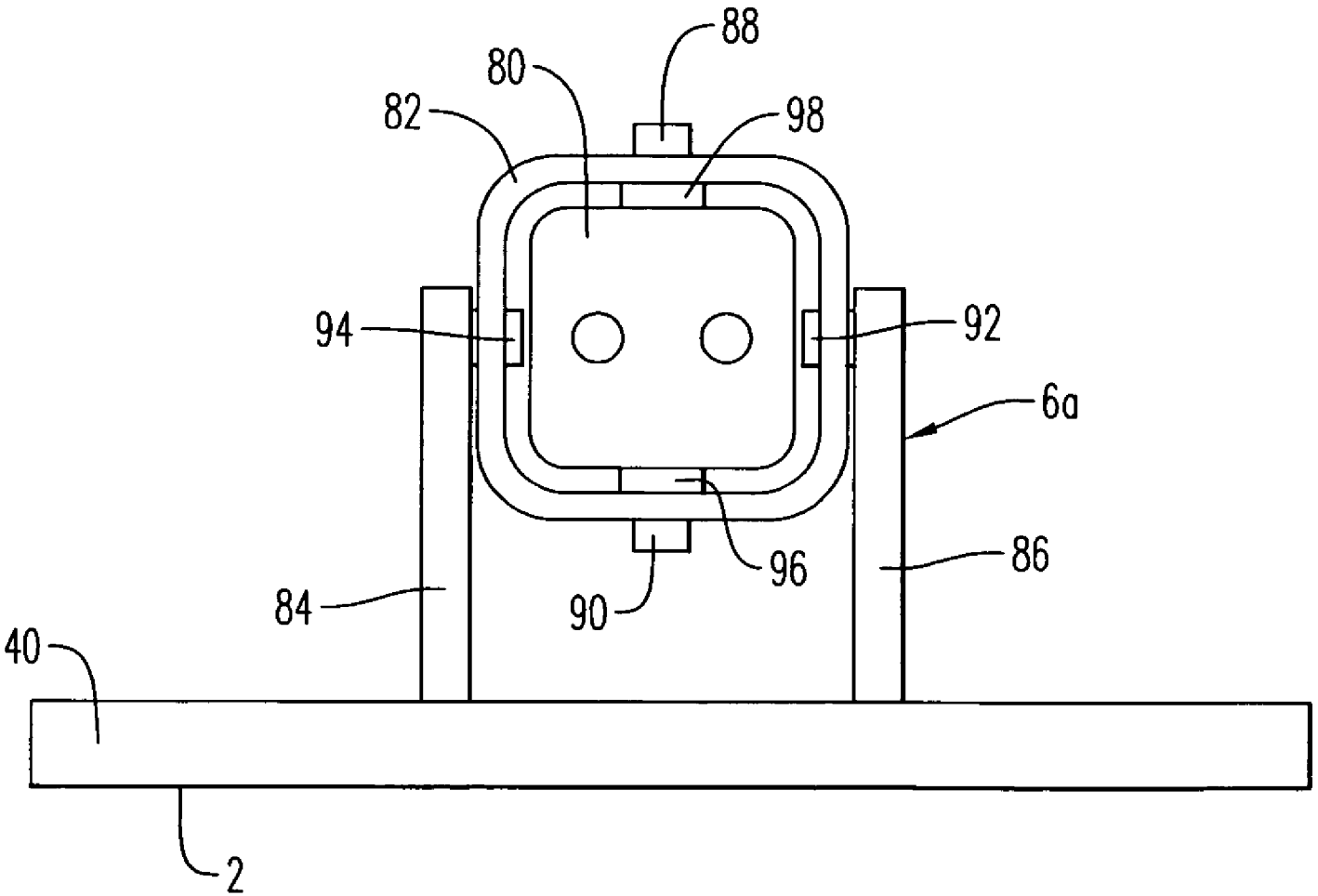
FIG. 5 is a plan view of a universal joint according to the present invention.

Turning now to FIG. 5, details of a preferred embodiment of the universal joint 6*a* are shown. The universal joint 6*a* includes cap 80 adapted to be attached to the upper end of the corresponding lifting cylinder by one or more suitable conventional threaded fasteners 46. A pair of generally parallel arms 84, 86 extend from the side rail 40 in the transverse direction toward the central region of the bed frame 2. Each arm 84, 86 carries a corresponding generally cylindrical axle pin 94, 96. The axle pins 92, 94 are coaxially aligned and generally parallel to the side rail 40 and are preferably parallel to the axle pins 52, 54 of universal joint 6*b*. The axle pins 92, 94 may be threadably connected to the corresponding arms so as to be removable. In addition, the axle pins 92, 94 connect with a generally rectangular collar 82 such that the collar 82 can rotate about the aligned axle pins 92, 94 relative to the arms 48, 50 but cannot slide longitudinally along the axle pins 92, 94 between those arms. Thus, the collar 70 and the arms 48, 50 do not accommodate any substantial longitudinal movement when the bed frame 2 precesses.

The cap 80 includes a pair of axle pins 88, 90 which are coaxially aligned and extend on opposite sides of the cap 80 to connect the cap 80 with the collar 82. The axle pins 88, 90 are coaxially aligned and extend in the transverse direction of the bed frame. Each axle pin 88, 90 includes a bushing or radial step 96, 98 having a larger lateral dimension larger than the end of the pin so that the collar 82 can rotate about the pins 88, 90 but is constrained from substantial sliding movement along the axle pins 88, 90. The universal joint 6*a* thus does not permit substantial sliding movement in either the longitudinal direction or the transverse direction.

Figure 6:
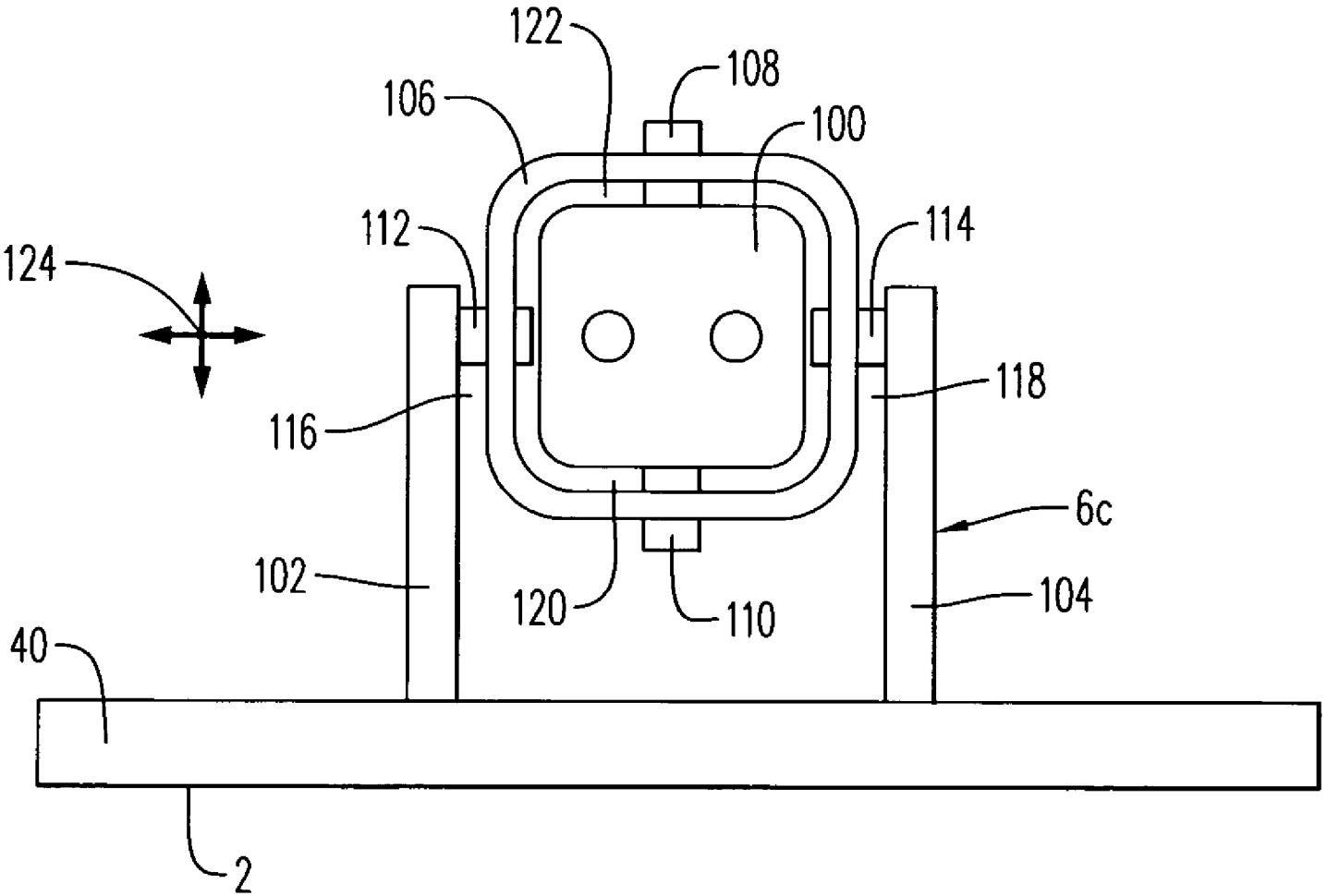
FIG. 6 is a plan view of a bi-axially adjustable universal joint according to the present invention.

Turning now to FIG. 6, details are shown of a preferred embodiment for the universal joint 6*c* which accommodates both longitudinal and transverse sliding of the bed frame 2 relative to the corresponding lifting cylinder. The universal joint 6*c* includes cap 100 adapted to be attached to the upper end of the corresponding lifting cylinder by one or more suitable conventional threaded fasteners. A pair of generally parallel arms 102, 104 extends from the side rail 40 in the transverse direction toward the central region of the bed frame 2. Each arm 102, 104 carries a corresponding generally cylindrical axle pin 112, 114. The axle pins 112,114 are coaxially aligned and generally parallel to the side rail 40. The axle pins 112, 114 may be threadably connected to the corresponding arms so as to be removable. In addition, the axle pins 112, 114 connect with a generally rectangular collar 106 such that the collar can rotate about the aligned axle pins 112, 114 relative to the arms 102, 104 and can slide longitudinally along the axle pins 112,114 between those arms. Thus, the collar 106 is spaced from the arms 102, 104 at the gaps 116, 118, but the relative size of the gaps 116, 118 is selected to accommodate any longitudinal movement that may be needed as the bed frame 2 precesses.

The cap 100 includes a pair of axle pins 108, 110 which are coaxially aligned and extend on opposite sides of the cap 100 to connect the cap 100 with the collar 106. The axle pins 108, 110 are coaxially aligned and extend in the transverse direction of the bed frame 2 and are generally parallel to the axle pins 88, 90 of universal joint 6*a*. The collar 70 can rotate about the pins 108, 110 but is not constrained from substantial sliding movement along the axle pins 60, 62. The universal joint 6*c* thus permits sliding movement in the direction of arrow 124 while otherwise permitting angular movement between the corresponding lifting cylinder 5 and the bed frame 2.

Figure 7:
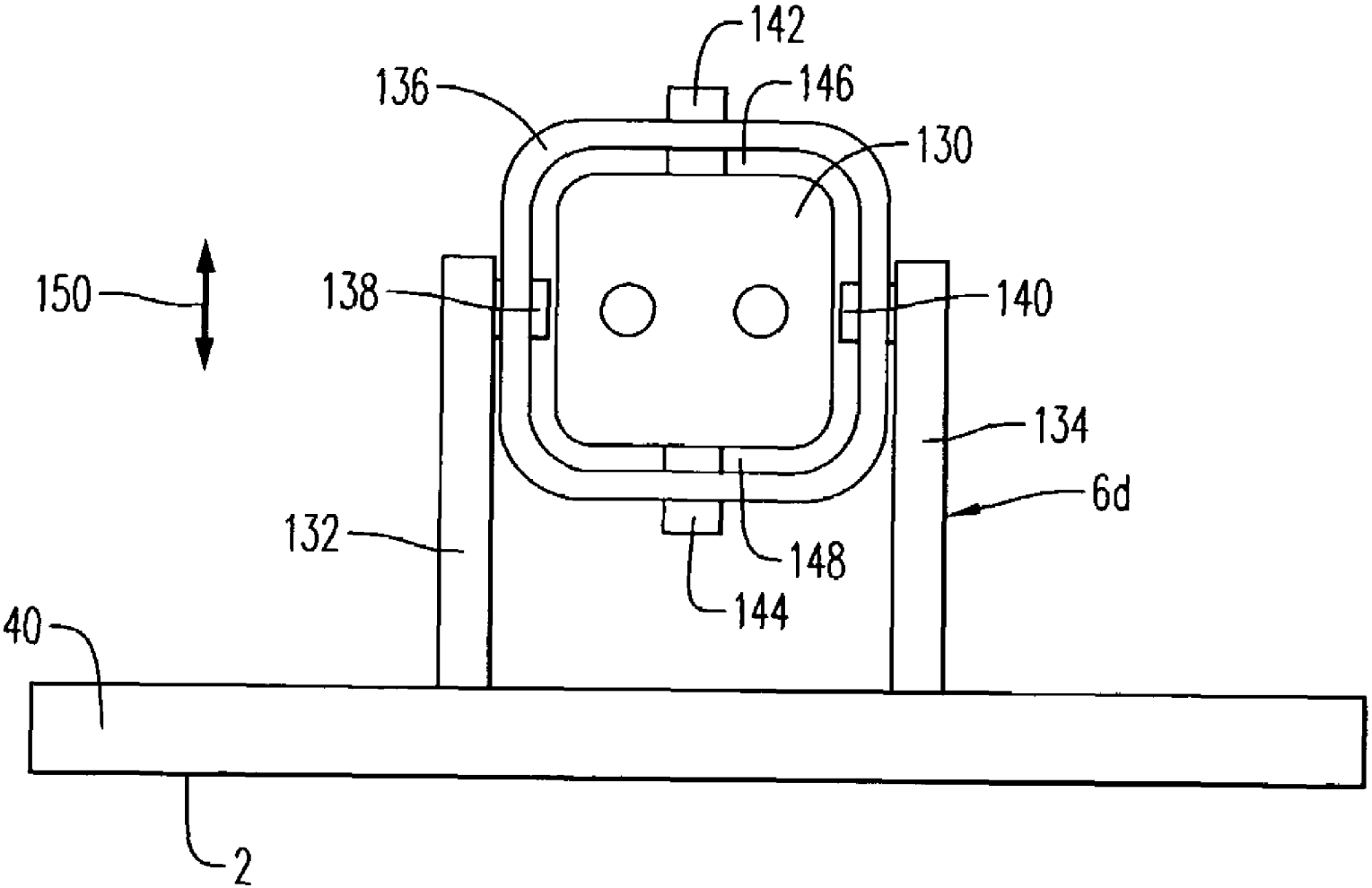
FIG. 7 is a plan view of a transversely adjustable universal joint according to the present invention.

Details of the universal joint 6*d*, which accommodates transverse sliding, are shown in FIG. 7. The universal joint 6*d* includes a cap 130 adapted to be attached to the upper end of the corresponding lifting cylinder by one or more suitable conventional threaded fasteners. A pair of generally parallel arms 132, 144 extends from the side rail 40 in the transverse direction toward the central region of the bed frame 2. Each arm 132, 134 carries a corresponding generally cylindrical axle pin 138, 140. The axle pins 138, 140 are coaxially aligned and generally parallel to the side rail 40. The axle pins 138, 140 may be threadably connected to the corresponding arms so as to be removable. In addition, the axle pins 138, 140 connect with a generally rectangular collar 136 such that the collar can rotate about the aligned axle pins 138, 140 relative to the arms 132, 134 but such that the collar 136 cannot slide longitudinally along the axle pins 138,140 between those arms.

The cap 130 includes a pair of axle pins 142, 144 which are coaxially aligned and extend on opposite sides of the cap 130 to connect the cap 130 with the collar 136. The axle pins 142, 144 are coaxially aligned and extend in the transverse direction of the bed frame. The collar 136 can rotate about the pins 142, 144 and can slide along the axle pins 142, 144. The universal joint 6*d* thus permits sliding movement in the direction of arrow 150 while otherwise permitting angular movement between the corresponding lifting cylinder and the bed frame.

If desired, the universal joint 6*c*, which accommodates both longitudinal and transverse movement, can be substituted for universal joint 6*b* (accommodating longitudinal movement) and/or universal joint 6*d* (accommodating transverse movement). Such substitutions might be preferred for example to reduce the number of parts for the sick bed.

The adjustable lifting column 5 (FIG. 1) is comprised of a number of telescoping spindles, which are movable through a motor and a corresponding gear, either the motor being configured as a reversing motor or, alternatively, the gear being configured as a reversing gear.

For the operation of the telescoping spindles, only the driving current for the motor and the voltage for the electronic signal unit are still required. Thereby, these elements could be designed so far miniaturized, due to the little power necessary, that in the way outlined in FIG. 1, an electric storage 7 and an electronic processor 8 are integrated in the bedstead 1 for all four of the telescopic columns in common.

The sick-bed for the decubitus prophylaxis described here, is characterized by an immediately responding spindle drive and a simple mobile energy supply, whereby a large number of accessories can be dispensed with, which in turn signifies a weight saving.

In operation, the telescopic lifting columns are controllable in such a manner that the central normal 9 of the bed frame running through the gravity center of the bed frame 2, carries out a continuous and slow precession movement without perceptible increments.

It will now be apparent to those skilled in the art that a new and improved sick-bed for avoiding and/or treating decubitis has been described. It will also be apparent to those skilled in the art that numerous modifications, variations, substitutions, and equivalents exist for features of the invention. Accordingly, it is expressly intended that all such modifications, variations, substitutions, and equivalents that fall within the spirit and scope of the claims should be encompassed by those claims.

What is claimed is:

1. A bed for the decubitus prophylaxis comprising:

a bedstead;

a bed frame mounted on said bedstead, having a generally planar mattress support; having a longitudinal direction, having a transverse direction, and the bed frame being dimensionally rigid;

at least three continuously height-adjustable lifting drives which are separate from each other, each lifting drive being connected between the bedstead and the bed frame with a universal joint, and the lifting drives providing the sole support for bed frame; and a drive unit connected with the lifting drives and operable to move the bed frame with a precessional frequency in the range of 6° to 36° per minute with a maximum amplitude in the range of 3 to 10 cm in the vertical direction;

wherein at least one of the universal joints permits biaxial sliding between the bed frame and a corresponding lifting drive.

2. A bed for the decubitus prophylaxis comprising:

a bedstead;

a bed frame mounted on said bedstead, having a generally planar mattress support; having a longitudinal direction, having a transverse direction, and the bed frame being dimensionally rigid;

at least three continuously height-adjustable lifting drives which are separate from each other, each lifting drive being connected between the bedstead and the bed frame with a universal joint, and the lifting drives providing the sole support for bed frame; and a drive unit connected with the lifting drives and operable to move the bed frame with a precessional frequency in the range of 6° to 36° per minute with a maximum amplitude in the range of 3 to 10 cm in the vertical direction;

wherein at least one of the universal joints permits longitudinal sliding between the bed frame and a corresponding lifting drive.

3. A bed for the decubitus prophylaxis comprising:

a bedstead;

a bed frame mounted on said bedstead, having a generally planar mattress support; having a longitudinal direction, having a transverse direction, and the bed frame being dimensionally rigid;

at least three continuously height-adjustable lifting drives which are separate from each other, each lifting drive being connected between the bedstead and the bed frame with a universal joint, and the lifting drives providing the sole support for bed frame; and a drive unit connected with the lifting drives and operable to move the bed frame with a precessional frequency in the range of 6° to 36° per minute with a maximum amplitude in the range of 3 to 10 cm in the vertical direction;

wherein at least one of the universal joints permits transverse sliding between the bed frame and a corresponding lifting drive.

* * * * *